United States Patent [19]

Trolle

[11] 3,937,057

[45] Feb. 10, 1976

[54] MANIPULATOR SYSTEM

[75] Inventor: Sten Trolle, Ystad, Sweden

[73] Assignee: AB Carbox, Ystad, Sweden

[22] Filed: Aug. 29, 1974

[21] Appl. No.: 501,685

[30] Foreign Application Priority Data

Sept. 3, 1973 Sweden ..... 7311956

[52] U.S. Cl. ..... 72/422; 72/426; 72/446; 72/455

[51] Int. Cl.[2] ..... B21D 43/10

[58] Field of Search ..... 72/421, 422, 405, 446, 72/455, 426; 29/568

[56] References Cited

UNITED STATES PATENTS

| | | | |
|---|---|---|---|
| 3,729,977 | 5/1973 | Motzer | 72/405 |
| 3,745,646 | 7/1973 | Kristianson | 72/446 |

*Primary Examiner*—C. W. Lanham
*Assistant Examiner*—Robert M. Rogers
*Attorney, Agent, or Firm*—Flynn & Frishauf

[57] ABSTRACT

A manipulator system for automatically feeding blanks into a gap press and for collecting finished articles therefrom has two major parts. The first part is a revolver table and the second part is an automatic handling device, or robot. The revolver table should be located between the press and the robot. It is stepwise rotatable around a vertical axis and has a number of arms each carrying a set of tools. The robot has at least two arms swingable around a vertical axis between positions for collecting blanks, for temporary holding of semiprocessed articles, as well as for placement of blanks and semifinished articles between selected tool sets on the arms of the revolver table and for sequential working in the press and for delivery of finished articles.

5 Claims, 8 Drawing Figures

MANIPULATOR SYSTEM

The present invention relates to a manipulator system adapted to cooperate with a gap press for the purpose of feeding into and out from the press workpieces which in the press should be subjected to a number of consecutive working operations.

In the machine shop industry there are carried out many types of working operations in which a given workpiece is worked upon in a press two or more times. It is here important to observe that the press need by no means always carry out a pressing operation in the strict sense of that word. Rather, as is well known, a press can also be equipped with tools carrying out cutting or folding operations. Various parts of automobile car bodies, especially side-doors and doors for the engine and luggage compartments, exemplify workpieces which are typically subjected to several consecutive working operations in a press. The usual procedure is to start from a flat blank which has initially been cut to its approximate final dimensions. By means of the press, the blank is then subjected to several consecutive treatments such as by way of example preforming, deep drawing, bending, cutting and final or finish adjustment. The prior art presently relies on either of two different basic principles for carrying through such a complete working operation.

The first principle involves using one and the same press for a plurality of different working cycles. This naturally means that the tools of the press have to be exchanged when a switch is made from one working step to a different one. Even if car body components consist of thin sheet metal the various parts are typically of large dimensions which calls for the use of heavy equipment in the form of large presses and tools. The corresponding great weights of the tools — often of the order of magnitude of tons — makes tool exchange a complicated procedure necessitating reliance on special auxiliary equipment such as travelling cranes and tool transport carts. For those reasons and since exchange of a tool is also a rather time-consuming procedure it is desirable to reduce the number of tool replacements. In other words this means that a given workpiece, which in one single press shall be subjected to a plurality of working steps requires a very long time for the complete treatment as all of the workpieces must be temporarily stored in the vicinity of the press until all of them have passed through all of the treatment steps. One obvious drawback is that large storing spaces are required. Further, as has already been indicated, the long run-through time ties up capital in large amounts of semiprocessed articles.

According to the second main principle, the one which presently dominates within the car industry, the disadvantages above discussed, namely frequent tool exchanges, long run-through times, etc., are avoided. This has been achieved in the way that a different press is used for each individual working step. Accordingly, as long as a press line comprising the required number of presses is busy manufacturing a given article and no tool is damaged there is no need to replace any tool until, after a very long time, this becomes necessary due to wear. However, there do on the other hand appear several other disadvantages the major one being naturally the multiplied requirement for capital investment and the increased required floor space. A further drawback is that, as a rule, such a press line gets such an excess capacity that the use thereof cannot be limited to one specific article only. Accordingly, even if each individual workpiece can pass along all of the press line without any interruption for the exchange of tools such an exchange has to be performed when the press line is to be adapted to working on a different article. It is not unusual in that way to manufacture five to six different articles in one and the same press line. As is easily realized, in order for satisfaction of the condition that each of those articles shall be available through the complete time span during which the presses are occupied by manufacturing the other articles, each manufacturing series must be relatively long. This calls for the establishment of corresponding intermediary stores. The disadvantages of that principle can accordingly be summarized as high investments for the machinery, a necessity to use the machinery for a plurality of different articles, access to storing spaces and corresponding interest costs.

The main object of the invention is to provide a manipulator system making it possible in a highly rational way to use one single press for performing a plurality of working steps without any passive time interval for tool exchange.

A further object of the invention is to provide a manipulator system capable of serving the press in a fully automatic way by supplying to the press blanks which are worked upon through the different steps, by permitting rapid and automatic tool exchange and by finally delivering the finished articles.

SUBJECT WRITTEN OF THE INVENTION

The press used is a gap press and it cooperates with a manipulator system comprising on the one hand a turret, or revolver table and, on the other, an automatic loader or handling apparatus, referred to as a robot. The revolver table is rotatable in a stepwise manner around a vertical axis and it has a number of arms corresponding to the number of working steps. Each of those arms support a tool set which can be swung into the press gap. The robot has at least two arms which are mounted for a swinging movement around a vertical shaft between positions corresponding to four various functions, namely collection of blanks, temporary holding of a semiprocessed blank, interchange of workpieces in an adjacent arm of the revolver table, and delivery of a finished article.

According to a preferred embodiment of the invention the turret, or revolving table is designed so that press dies or opposed press tools of each tool or die set can assume two different relative positions outside the press gap. In one of those positions the two tools are at a large mutual distance which is necessary for the robot to shift workpiece or, alternatively, significantly facilitates that operation of the robot. In the second position the two tools are closely adjacent and loaded with a workpiece. Thanks to the fact that the tools, after having received a workpiece not yet worked upon, are moved towards each other into a stand-by position in which they can both contact the workpiece and, reversely, thanks to the fact that the tools upon a completed working step are moved out from the press gap and not until there are separated as called for by the robot, the stroke of the press could be significantly reduced, by way of example to about 40% of the value necessary when the present invention is not applied. That preferred embodiment of the invention results in an optimized operation of the complete plant comprising the manipulator and the press served thereby.

Further objects, advantages and characteristics of the invention will appear from the following description when read in conjunction with the accompanying drawings. It should be pointed out here that the drawing has been made rather diagrammatic because the purpose of it is to illustrate a new working principle of a system the various components of which can be of conventional design.

Figure 8:
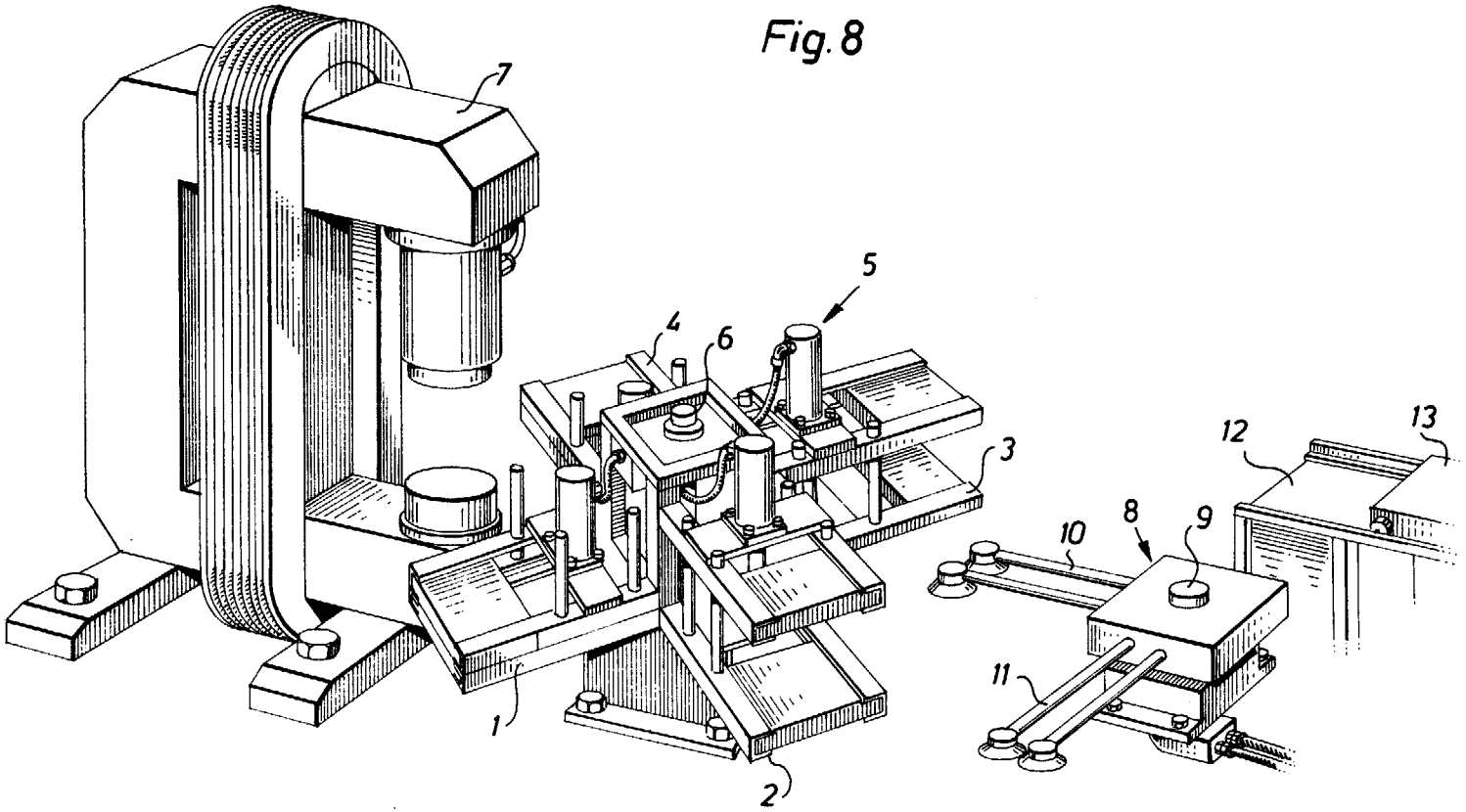
FIG. 8 is a perspective view showing the complete system and also a gap press served thereby.

The manipulator system shown in the general drawing of FIG. 8 comprises two main portions, namely on the one hand a tool holder 5 operating according to the revolver principle and, on the other, a robot 8. Those two devices do together automatically serve a gap press 7 by successively feeding into the gap of the press the necessary tools and the workpieces.

Revolver 5 does according to the embodiment here illustrated comprise four arms 1, 2, 3 and 4 which are arranged crosswise. Each of the arms carries a tool set at its free end, generally an upper tool and a lower tool. The tools have not been shown in greater detail, since their exact shape is completely immaterial in the present context. As is understood, when the individual ones of the tool sets are actuated upon by press 7 they perform a working operation on the workpiece. It should be observed that it is, however, not any characteristic of the invention to use a revolver comprising four arms. On the contrary, the skilled artisan will understand that the number of arms can be varied depending on the actual conditions and be greater as well as less than four. At any rate, revolver 5 performs consecutive introduction of each of the tool sets into the gap of press 7 or, stated in other words, it carries out exchange of the tools in the press.

The task which robot 8 has to perform is to exchange workpieces in the arms of the revolver upon passage of a revolver arm past the robot. The principle according to which that shifting takes place will be described in greater detail below. From the above description it should, however, be apparent that the complete manipulator system is capable of shifting tools in the press and shifting workpieces in the tools in a fully automatic manner. Revolver 5 is adapted for stepwise rotation around a vertical shaft 6 and that rotational movement is unidirectional as has been marked with an arrow. Robot 8 has two arms 10 and 11 which can oscillate around a second vertical shaft 9. However, robot 8 performs two further functions in addition to the one already dealt with, to exchange workpieces in the revolver thereby assuring that a given workpiece which has been subjected to a certain working step in a certain tool set is transferred to the tool set which is to perform the next working step. The first one of those two additional functions is that robot 8 loads the revolver with blanks by collecting blanks from a blank store 12 and moving each collected blank to the revolver where it is received by the tool set designed to carry out the first operational step. The second additional function is that robot 8 receives a workpiece which has been subjected to all of the working steps and transfers that finished workpiece to a conveyor 13.

The basic operation of the manipulator system has been stated above in broad terms. For the purpose of further to illustrate the invention and to facilitate the understanding thereof the operation will now be described in greater detail with reference to the specific embodiment here selected for the purpose of exemplifying the practical working of the invention.

Figure 1:
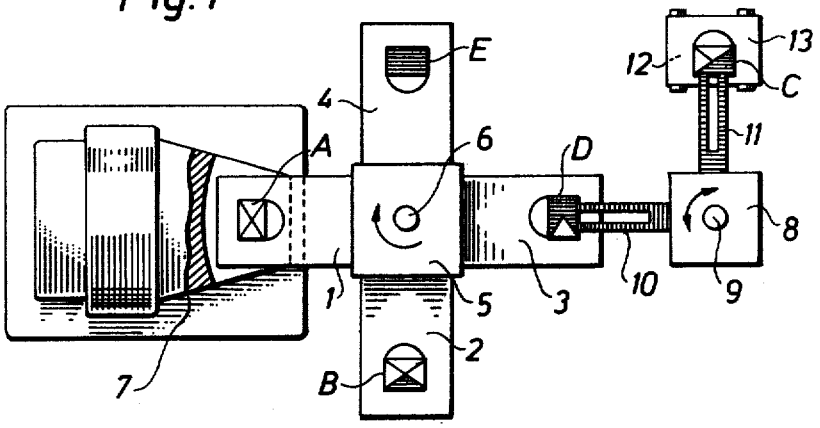
FIGS. 1–7 are top views illustrating the operation of the system by showing the different steps making up the working cycles of the revolver table and of the robot.

FIG. 1 shows an initial position in which arm 1 of revolver 5 is located in the gap of press 7 and there holds a workpiece A. That workpiece has at the stage shown in FIG. 1 not yet been actuated by the tools gripping it. The same applies to workpiece B which is in revolver arm 2 and which has in a precedent cycle been treated by the tools of arm 1. For the purpose of still further to facilitate the following description of the operation the actual state of treatment of each individual workpiece has also been shown in a pictorial manner, more specifically in the way that each workpiece has been symbolized by a rectangle having two diagonals and the area of each such rectangle has been shadowed corresponding to the number of operation steps performed. Accordingly, a rectangle which is not shadowed at all refers to a complete unwrought blank. A workpiece which has been subjected to the first step has been shadowed within one quarter of its area — such as shown at B in arm 2 according to FIG. 1. Correspondingly, workpieces shadowed to 50%, 75% and 100% are such which have been subjected to 2, 3 and 4, respectively, of the totally four working steps. It appears from FIG. 1 that workpieces D and E — which, counted in the rotational direction of the revolver, are located downstream of the press gap — have already been actuated upon by the tools carrying them at that stage.

The two robot arms 10 and 11 are rigidly interconnected for reciprocating swinging movements around vertical shaft 9 and at their free ends provided with means for gripping the workpieces. Those means do not constitute any part of the present invention and can be of any known or suitable type, such as pneumatic suction cups or electromagnets. They have in FIG. 1 been shown each holding one workpiece. According to the illustrated embodiment the vertical shaft of the working cylinder of the press and shafts 6 and 9 are located along a straight line. Robot arm 10 does in FIG. 1 cooperate with revolver arm 3 opposite to arm 1 which is received in the gap of the press. Arm 10 holds workpiece D which, as has already been mentioned above and as is apparent from the symbols used, has been subjected to three of the totally four working steps. Robot arm 11 is temporarily holding a workpiece C which it has collected from arm 2 when the latter was in the position now assumed by arm 3. Arm 11 temporarily holds workpiece C in a position above conveyor 13 and blank store 12.

Figure 2:
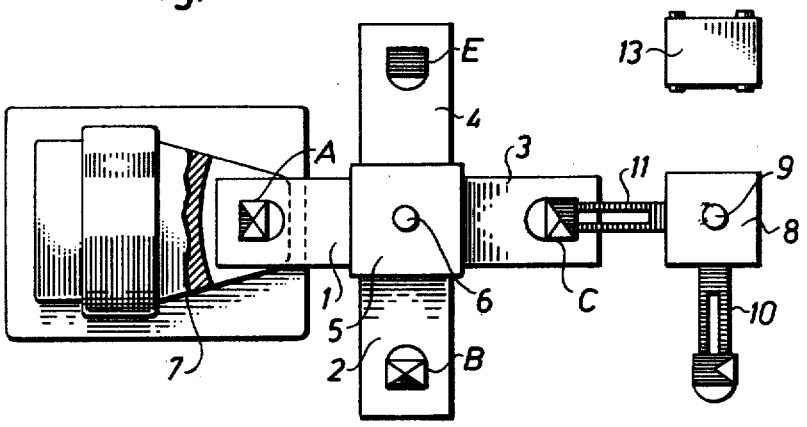

There are two differences between FIG. 2 and FIG. 1. Firstly, workpiece A has been treated in the press by the tools of arm 1 which has accordingly been indicated in the way that 25% of the corresponding rectangle is shadowed. Secondly, robot arms 10 and 11 have been rotated through 90° counter-clockwise so that arm 11 holding workpiece C is now between the tools of revolver arm 3 whereas arm 10 is temporarily holding workpiece D which is due for receipt by the tools of revolver arm 4. Workpiece C, which already has been subjected to two operation steps, is accordingly now introduced into the proper tool set for being subjected to the third step.

Figure 3:
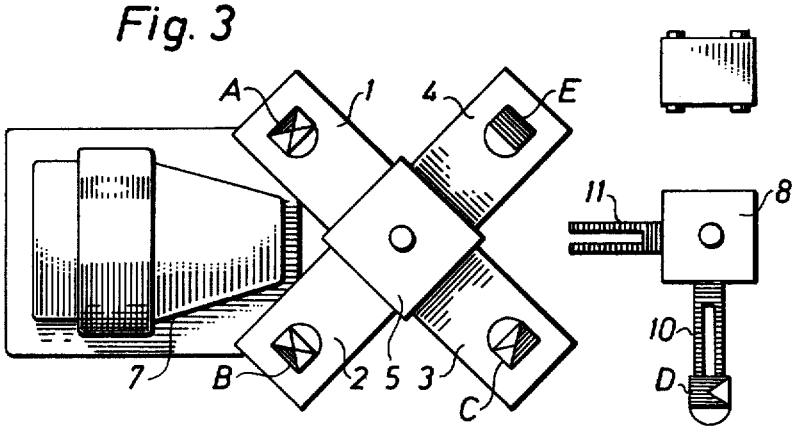

FIG. 3 illustrates an intermediate position corresponding to a rotation through 45° of the revolver table. Robot arm 11 has now released workpiece C which is transferred by revolver arm 3. Apart therefrom the conditions are the same at robot 8.

Figure 4:
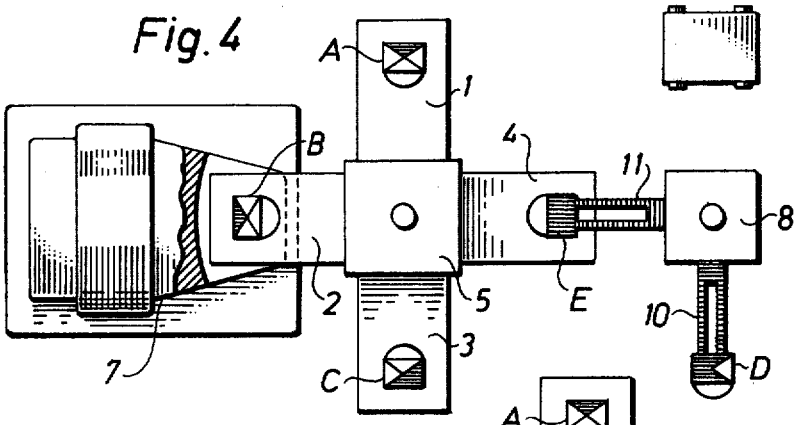

According to FIG. 4 revolver table 5 has completed rotation through 90° as compared to FIGS. 1 and 2. The workpiece B which has so far been subjected to one working step is now located in the press gap between the tools carried by arm 2. Robot arms 10 and 11 assume the same rotational positions as in FIG. 3 which means that workpiece D subjected to three operational steps is still in a stand-by position swung away from revolver 5. Arm 11 grips workpiece E upon which all the four operational steps have been completed.

Figure 5:
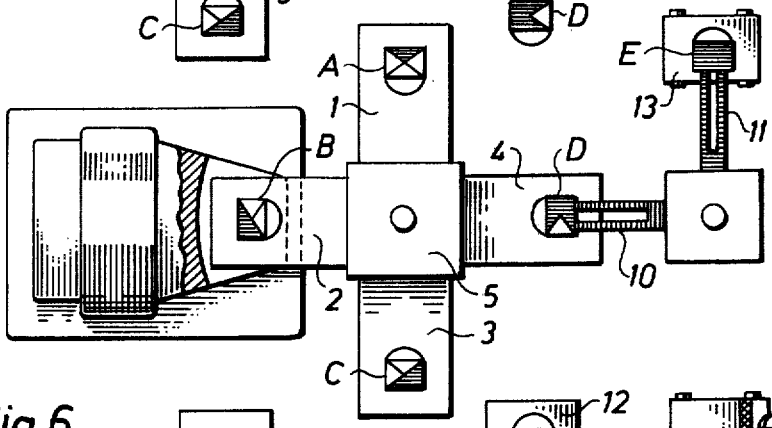

It appears from FIG. 5 that workpiece B has then been treated in the press. The rotational position of revolver 5 is unchanged whereas robot arms 10 and 11 have been swung back to their initial position according to FIG. 1. Arm 11 is prepared to deliver to conveyor 13 the finished workpiece E, whereas arm 10 is delivering workpiece D to the fourth tool set of the revolver.

Figure 6:
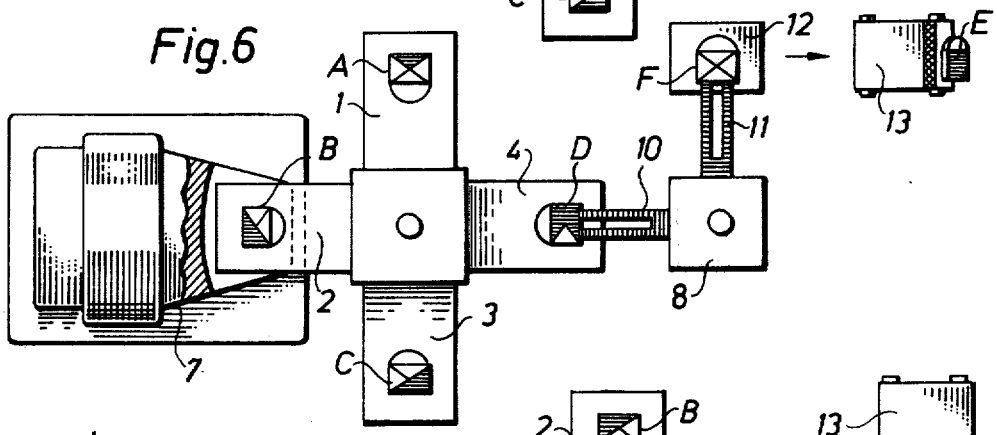

FIG. 6 shows the press, the revolver and the robot in the same conditions as in FIG. 5 but illustrates how the finished article E is transferred away from the system by means of conveyor 13 and also how arm 11 has now instead seized a further blank F.

Figure 7:
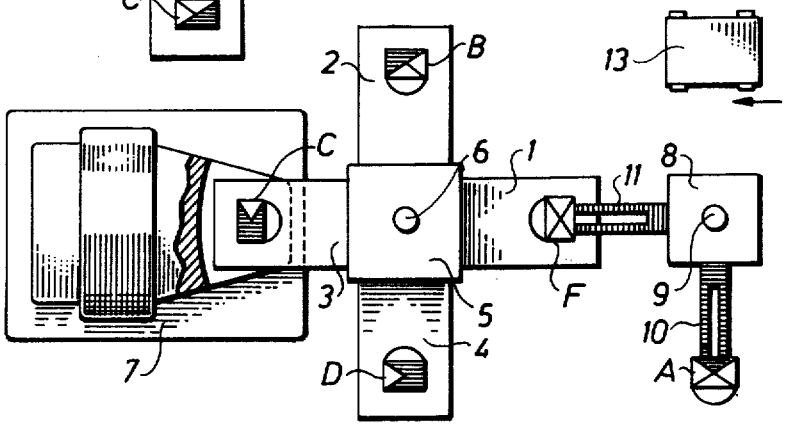

When robot arm 10 has transferred workpiece D to the tool set carried by arm 4, revolver 5 is turned through another 90° to the position shown in FIG. 7. There workpiece C is treated upon by the third tool set (compare FIG. 2, where workpiece C was loaded). The robot arms have been rotated through 90° counterclockwise so that arm 11 transfers blank F to the first tool set carried by rovolver arm 1 whereas robot arm 10 holds workpiece A in a stand-by position.

The process above described is then repeated cyclically and, as is understood, the invention provides an optimized use of the press thanks to the fact that exchange of press tools takes place outside the press by means of a revolver table meaning that no tool mounting or demounting works are necessary. The optimized operation is also due to the fact that the robot transfers the workpieces between the different tool sets. Thanks to those two circumstances the limitations of prior art press lines have been completely eliminated.

It has already been mentioned that the productivity of the gap press served by the system can be increased and that the size of the press — and thence also the corresponding investment — can be decreased if the revolver table is designed so that its tool sets open outside the press thereby giving the robot the necessary access space between the tools and to a distance in excess of the press gap. Before a given tool set is again introduced into the press gap the two tool halves are, however, again brought into positions close to each other. The net result is that the total stroke of the press can be considerably decreased. This does not only mean that the manufacturing cost of the press is reduced and the press productivity increased but, in addition thereto, one eliminates the disadvantages which occur in big hydraulic presses due to the large volume of the hydraulic liquid in combination with its inherent compressibility. At such large volumes the compressibility shows up in the form of reduced possibilities to control the pressing process in an exact manner. The drawback of large hydraulic liquid volumes per se stem from the difficulties rapidly to transport considerable liquid amounts through valves and tubes. It should, however, be apparent that it is not at all necessary that the tool sets of the revolver are opened outside the press. Also in other respects it is possible within the scope of the invention to deviate from the embodiment here illustrated. The only essential condition is that the press tools are not carried by the press proper but by a revolver table consecutively feeding the tool sets into and out from the press gap, the revolver table being in turn served by a robot device performing three different functions, namely introduction of blanks into the revolver, transfer of semiprocessed workpieces between the different tool sets of the revolver, and removal of finished articles from the revolver. It should be observed that the term "blank" has been used here to designate a workpiece which has not been treated by any of the tools carried by the revolver. Correspondingly, the term "finished article" has been used to designate an article which has completed its run through the revolver and the press. This means on the one hand that a blank supplied to the system may already have been processed by some other machinery and, correspondingly, that a finished article leaving the system can be subjected to further treatment in some other equipment.

It is to be observed that also according to the embodiment of the invention when the revolver is provided with special means for opening a tool set outside the press, the tools may be partially or completely separated by means of the press. In certain applications, when a pressing operation has been completed, very high forces are necessary for the initial separation of the two tool halves which means that it is practical for that purpose to rely on the hydraulic system of the press. A practical solution of that problem is to provide the upper tool half of each tool set with guide rails or the like having a radius of curvature corresponding to their distance from the rotational axis of the revolver. When the tool set is swung into the press gap, those guide rails are brought into engagement with complementary means carried by the press. In this way it becomes feasible to rely on the press piston to generate forces for separating the two tool halves in spite of the fact that the piston is not permanently secured to the tools. When such separation has taken place and the press piston has been released so that no axial forces act between the just-mentioned means, it is possible by rotation of the revolver to move the work tool out from the press gap in the normal way during which movement the engagement between the press piston and the upper tool half is automatically interrupted. The final opening up of the tool set that is necessary to permit withdrawal of the workpiece may then be affected by means carried by the revolver. Finally, it should be underlined that the term "tool set" has been used here in a descriptive rather than in a limiting sense. Thus, it is according to the invention not necessary that each revolver arm has a complete tool set comprising an upper and a lower tool because, in such cases when two or more consecutive operational steps can be carried through without calling for replacement of one of the two tool halves such a tool can remain in the press. The word "tool" has been used here to signify not only conventional press tools but also any other corresponding means cooperating with a tool, such as a die.

What is claimed is:

1. In combination with a press (7) a manipulator system adapted automatically to supply to the press workpieces to be treated by the press in several consecutive steps, and automatically to remove treated articles from the press, comprising a revolver table (5) rotatable around a vertical axis (6) and having a number of arms (1–4) corresponding to the number of workings steps to be performed by the press, each revolver arm (1–4) having a tool set movable through the gap of the press;

and, a robot (8) having at least two arms (10, 11) movable in a horizontal plane between a first position for picking up an untreated workpiece, a second position for placement of a workpiece between the tool set of a revolver table arm, located adjacent the second position of the respective robot arm, and a third position for delivery of a finished workpiece.

2. A manipulator system as claimed in claim 1, in which each tool set comprises an upper tool and a lower tool, means being provided outside the press automatically to move the tools of the tool set between an open position in which the height of the set exceeds the maximum height of the press gap permitting the robot arms to replace the workpiece treated by the tools, and a closed position in which the height of the set is reduced permitting introduction of the set into the press gap.

3. A manipulator system as claimed in claim 1, in which the robot arms are rigidly interconnected for rotation in unison.

4. A manipulator system as claimed in claim 1, in which the robot arms are arranged to rotate between said first, second and third positions.

5. A manipulator system as claimed in claim 1, in which the robot has two arms extending in directions the angular difference of which is approximately 90°.

* * * * *